US005836175A

United States Patent [19]

Bonaquist

[11] Patent Number: 5,836,175

[45] Date of Patent: Nov. 17, 1998

[54] DUAL COLUMN CRYOGENIC RECTIFICATION SYSTEM FOR PRODUCING NITROGEN

[75] Inventor: Dante Patrick Bonaquist, Grand Island, N.Y.

[73] Assignee: Praxair Technology, Inc., Danbury, Conn.

[21] Appl. No.: 920,861

[22] Filed: Aug. 29, 1997

[51] Int. Cl.[6] ..... F25J 3/00

[52] U.S. Cl. ..... 62/652

[58] Field of Search ..... 62/652

[56] References Cited

U.S. PATENT DOCUMENTS

| | | | |
|---|---|---|---|
| 3,210,951 | 10/1965 | Gaumer, Jr. | 62/29 |
| 4,617,037 | 10/1986 | Okada et al. | 62/652 |
| 4,769,055 | 9/1988 | Erickson | 62/22 |
| 4,796,431 | 1/1989 | Erickson | 62/31 |
| 5,098,457 | 3/1992 | Cheung et al. | 62/24 |
| 5,148,680 | 9/1992 | Dray | 62/24 |
| 5,392,609 | 2/1995 | Girault et al. | 62/25 |
| 5,402,647 | 4/1995 | Bonaquist et al. | 62/24 |
| 5,582,034 | 12/1996 | Naumovitz | 62/652 |
| 5,611,219 | 3/1997 | Bonaquist | 62/646 |

*Primary Examiner*—Ronald Capossela
*Attorney, Agent, or Firm*—Stanley Ktorides

[57] ABSTRACT

A dual column cryogenic rectification system for producing high purity nitrogen at elevated pressure wherein top vapor from a first column is processed in an intermediate heat exchanger of a second column and oxygen-rich vapor from the second column is turboexpanded to generate refrigeration for the separation.

10 Claims, 3 Drawing Sheets

DUAL COLUMN CRYOGENIC RECTIFICATION SYSTEM FOR PRODUCING NITROGEN

TECHNICAL FIELD

This invention relates generally to cryogenic rectification of air and, more particularly, to cryogenic rectification of feed air to produce nitrogen. It is particularly useful for producing high purity nitrogen at elevated pressure and, optionally, for additionally producing low purity oxygen.

BACKGROUND ART

In many industrial applications it is desirable to use high purity nitrogen at elevated pressure. For example, in glassmaking or in aluminum or steel melting, high purity nitrogen is used as an inerting atmosphere for the molten material. It is well known to produce high purity nitrogen by the cryogenic rectification of air but such known systems generally require the compression of high purity nitrogen from the cryogenic rectification column to produce elevated pressure product. Such compression invariably adulterates the nitrogen product such as with particulate matter. Single column systems can produce elevated pressure nitrogen directly from the column but at a high unit separation power requirement. Moreover, it is desirable in many of the aforesaid industrial applications to also use low purity oxygen. For example, in the glassmaking, steel heating and aluminum melting applications referred to above, low purity oxygen is employed in oxy-fuel combustion to provide heat for the heating and melting of the furnace charge.

Accordingly, it is an object of this invention to provide a cryogenic rectification system that can effectively produce high purity nitrogen at elevated pressure.

It is another object of this invention to provide a cryogenic rectification system that can effectively produce high purity nitrogen at elevated pressure and optionally also produce low purity oxygen.

SUMMARY OF THE INVENTION

The above and other objects, which will become apparent to one skilled in the art upon a reading of this disclosure, are attained by the present invention, one aspect of which is:

A method for producing nitrogen comprising:

(A) passing feed air into a first column and separating feed air within the first column by cryogenic rectification into oxygen-enriched bottom liquid and nitrogen-enriched top vapor;

(B) passing oxygen-enriched bottom liquid from the first column into a second column and producing oxygen-rich bottom liquid and nitrogen-rich top vapor by cryogenic rectification within the second column;

(C) vaporizing at least some of the oxygen-rich bottom liquid to produce oxygen-rich vapor;

(D) condensing nitrogen-enriched top vapor by indirect heat exchange with fluid from above the bottom of the second column;

(E) turboexpanding a portion of the oxygen-rich vapor; and (F) recovering nitrogen-rich top vapor as product nitrogen.

Another aspect of the invention is:

Apparatus for producing nitrogen comprising:

(A) a first column and means for passing feed air into the first column;

(B) a second column having a bottom reboiler and an intermediate heat exchanger;

(C) means for passing fluid from the lower portion of the first column into the second column;

(D) means for passing fluid from the upper portion of the first column through the intermediate heat exchanger;

(E) a turboexpander and means for passing fluid from the lower portion of the second column through the turboexpander; and (F) means for recovering fluid from the upper portion of the second column as product nitrogen.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "feed air" means a mixture comprising primarily oxygen and nitrogen, such as ambient air.

As used herein the term "low purity oxygen" means a fluid having an oxygen concentration within the range of from 50 to 98.5 mole percent.

As used herein, the term "high purity nitrogen" means a fluid having an nitrogen concentration greater than 98.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column.

As used herein, the term "intermediate heat exchanger" means a reboiler that boils liquid from above the bottom of a column.

The numerals in the Figures are the same for the common elements.

DETAILED DESCRIPTION

The invention will be described in detail with reference to the Drawings.

Figure 1:
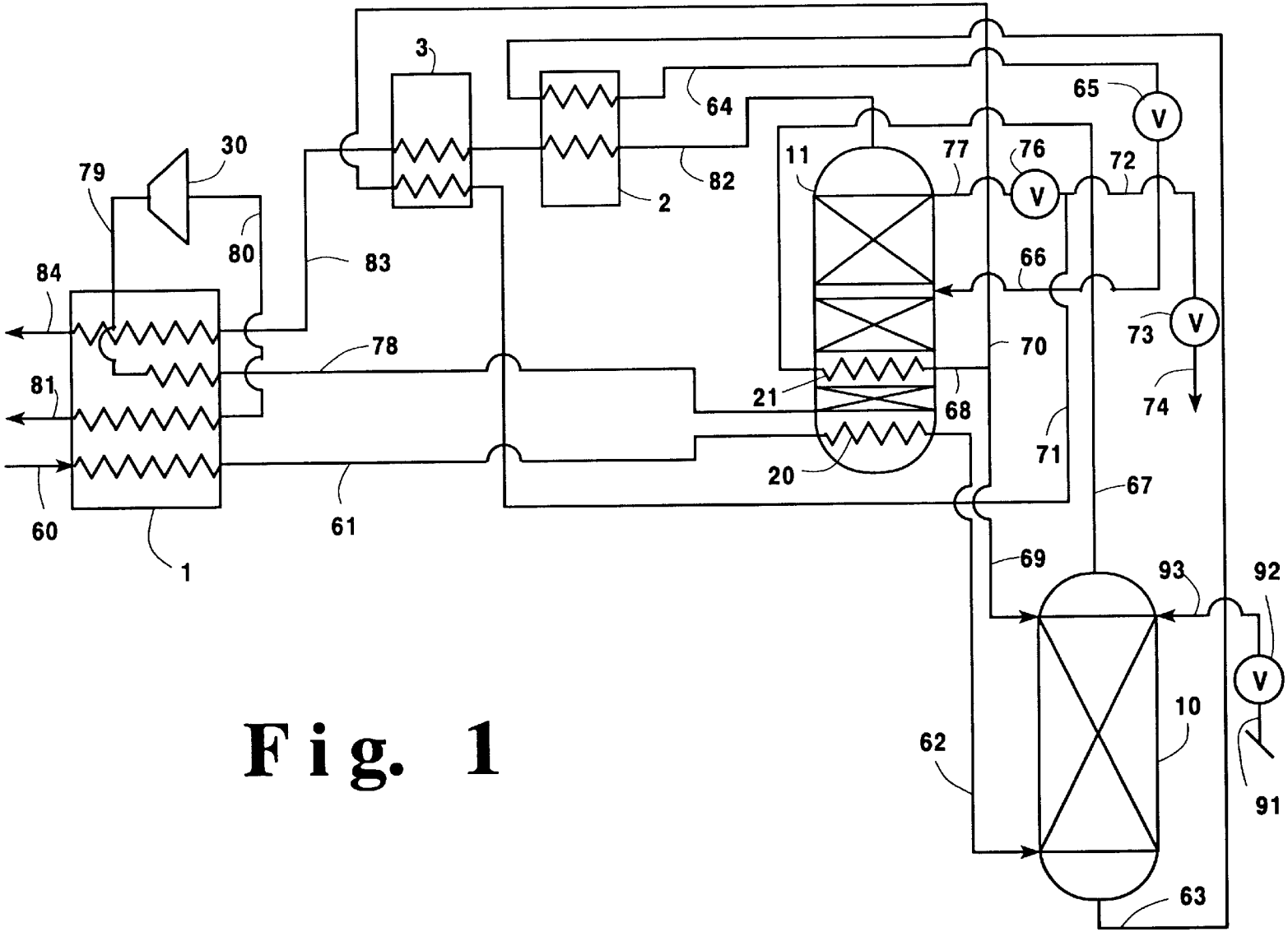
FIG. 1 is a schematic representation of one preferred embodiment of the invention.

Referring now to FIG. 1, feed air 60 which has been cleaned of high boiling impurities such as water vapor, carbon dioxide and hydrocarbons, and is at a pressure generally within the range of from 60 to 200 pounds per square inch absolute (psia), is cooled by passage through primary heat exchanger 1 by indirect heat exchange with return streams as will be discussed in greater detail below. Resulting cooled feed air stream 61 is at least partially condensed by passage through bottom reboiler 20 of column 11 thus serving to reboil the column 11 bottom liquid. Resulting feed air stream 62 is passed from bottom reboiler 20 into first column 10 which is operating at a pressure generally within the range of from 55 to 195 psia.

Within first column 10 the feed air is separated by cryogenic rectification in oxygen-enriched bottom liquid and nitrogen-enriched top vapor. Oxygen-enriched bottom liquid is withdrawn from the lower portion of first column 10 in stream 63 and subcooled by passage through heat exchanger 2. Resulting stream 64 is passed through valve 65 and, as stream 66, into second column 11 which has bottom reboiler 20 and intermediate heat exchanger or reboiler 21 and is operating at a pressure less than that of first column 10 and generally within the range of from 25 to 70 psia. Stream 66 is passed into second column 11 at from 1 to 20 equilibrium stages above intermediate heat exchanger 21.

Nitrogen-enriched top vapor is withdrawn from the upper portion of first column 10 in stream 67 and passed through intermediate heat exchanger 21 wherein it is condensed by indirect heat with fluid from second column 11 above bottom reboiler 20. Intermediate heat exchanger 21 is positioned at least 1 equilibrium stage and generally within the range of from 5 to 20 equilibrium stages above bottom reboiler 20.

Resulting nitrogen-enriched liquid is withdrawn from intermediate heat exchanger 21 as stream 68 and a portion 69 is passed into the upper portion of first column 10 as reflux. If desired, additional liquid nitrogen 91 may be passed through valve 92 and as stream 93 into the upper portion of first column 10 as additional reflux. Another portion 70 of the nitrogen-enriched liquid 68 is subcooled by passage through heat exchanger 3. Resulting stream 71 is passed through valve 76 and as stream 77 into the upper portion of second column 11. If desired, a portion 72 of stream 71 may be passed through valve 73 and recovered as product high purity nitrogen liquid 74.

Within second column 11 the various feeds are separated by cryogenic rectification into oxygen-rich bottom liquid and nitrogen-rich top vapor. At least a portion of the oxygen-rich bottom liquid is vaporized by the aforesaid indirect heat exchange with the feed air passing through bottom reboiler 20 to produce oxygen-rich vapor. A portion of the oxygen-rich vapor is passed up second column 11 as vapor upflow. Another portion of the oxygen-rich vapor, generally having an oxygen concentration within the range of from 60 to 95 mole percent, is withdrawn from the lower portion of second column 11 as stream 78 and warmed by partial traverse of primary heat exchanger 1. Resulting oxygen-rich vapor stream 79 is then turboexpanded by passage through turboexpander 30 and resulting turboexpanded oxygen-rich stream 80 is passed through primary heat exchanger 1 wherein it is warmed, thus serving to cool by indirect heat exchange feed air stream 60. The warmed oxygen-rich stream 81 withdrawn from primary heat exchanger 1 is then passed out of the system. Some or all of stream 81 may be recovered as product low pressure low purity oxygen.

Nitrogen-rich top vapor is withdrawn from the upper portion of second column 11 as stream 82 and warmed by passage through heat exchangers 2 and 3. Resulting stream 83 is warmed by passage through primary heat exchanger 1 and recovered as product high purity nitrogen 84 generally at a pressure within the range of from 23 to 68 psia.

Figure 2:
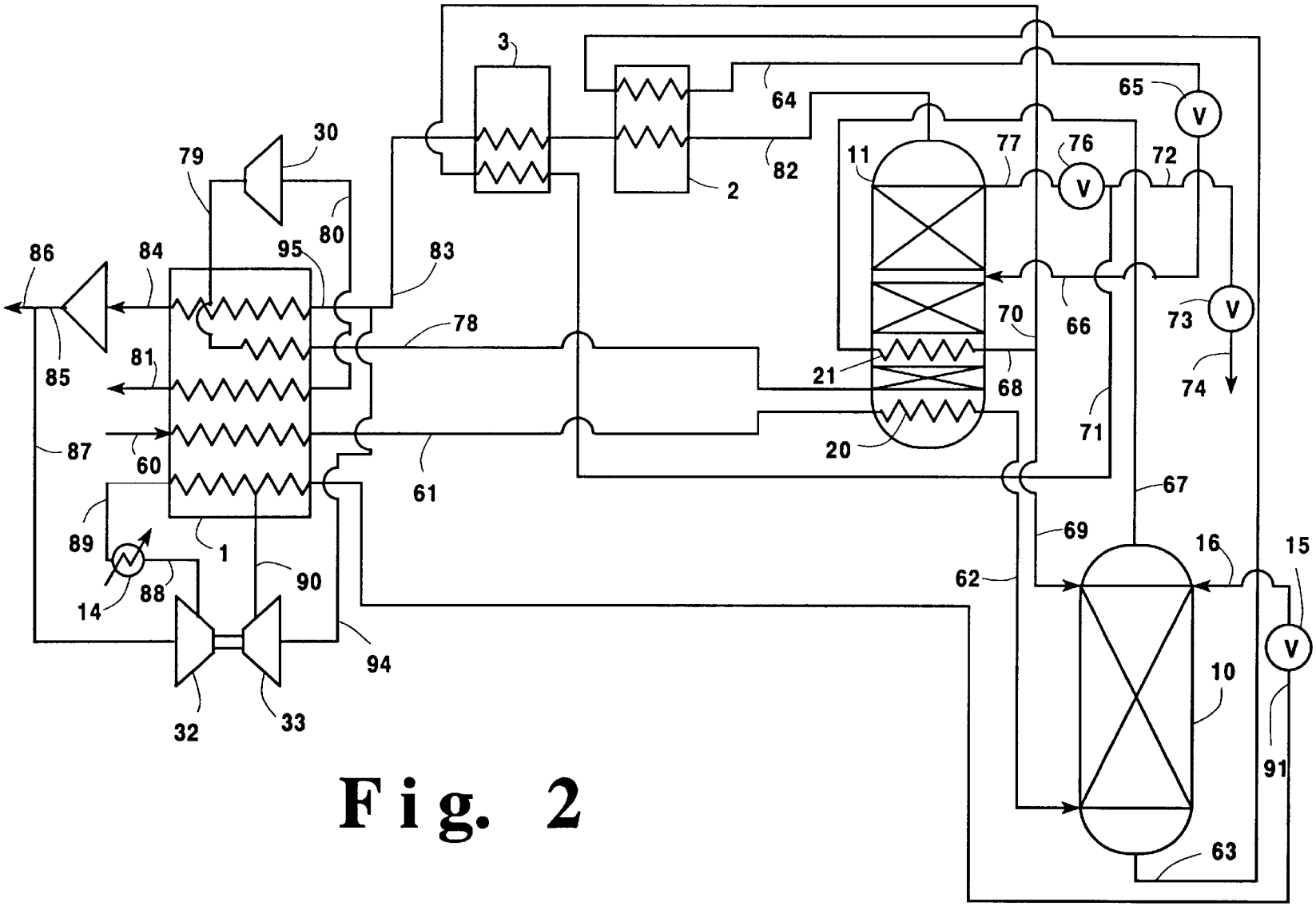
FIG. 2 is a schematic representation of another preferred embodiment of the invention wherein high purity nitrogen is compressed in a recycle loop enabling enhanced liquid production.

FIG. 2 illustrates another embodiment of the invention which may be used if a higher level of liquid production is desired. Those aspects of the embodiment illustrated in FIG. 2 which are common with the embodiment illustrated in FIG. 2 will not be discussed again in detail.

Referring now to FIG. 2 at least some of high purity nitrogen product stream 84 is compressed by passage through nitrogen product compressor 31 to a pressure generally within the range of from 70 to 250 psia. Resulting stream 85 is divided into portion 86 which is recovered as product high purity elevated pressure nitrogen, and into portion 87 which is passed into compressor 32 which is directly coupled to turboexpander 33. Stream 86 is compressed by passage through compressor 32 to a pressure generally within the range of from 85 to 300 psia and resulting stream 88 is cooled of heat of compression by passage through cooler 4 and passed as stream 89 into primary heat exchanger 1. A first portion 90 of stream 89 is withdrawn after partial traverse of primary heat exchanger 1 and turboexpanded by passage through turboexpander 33. Resulting turboexpanded stream 94 is then combined with stream 83 to form stream 95 which is passed into the cold end of primary heat exchanger 1 and then passed as product stream 84 to nitrogen product compressor 31. A second portion 91 of stream 89 undergoes complete traverse of primary heat exchanger 1 wherein it is condensed. There-after it is passed through valve 15 and as stream 16 into the upper portion of first column 10 as additional reflux.

Figure 3:
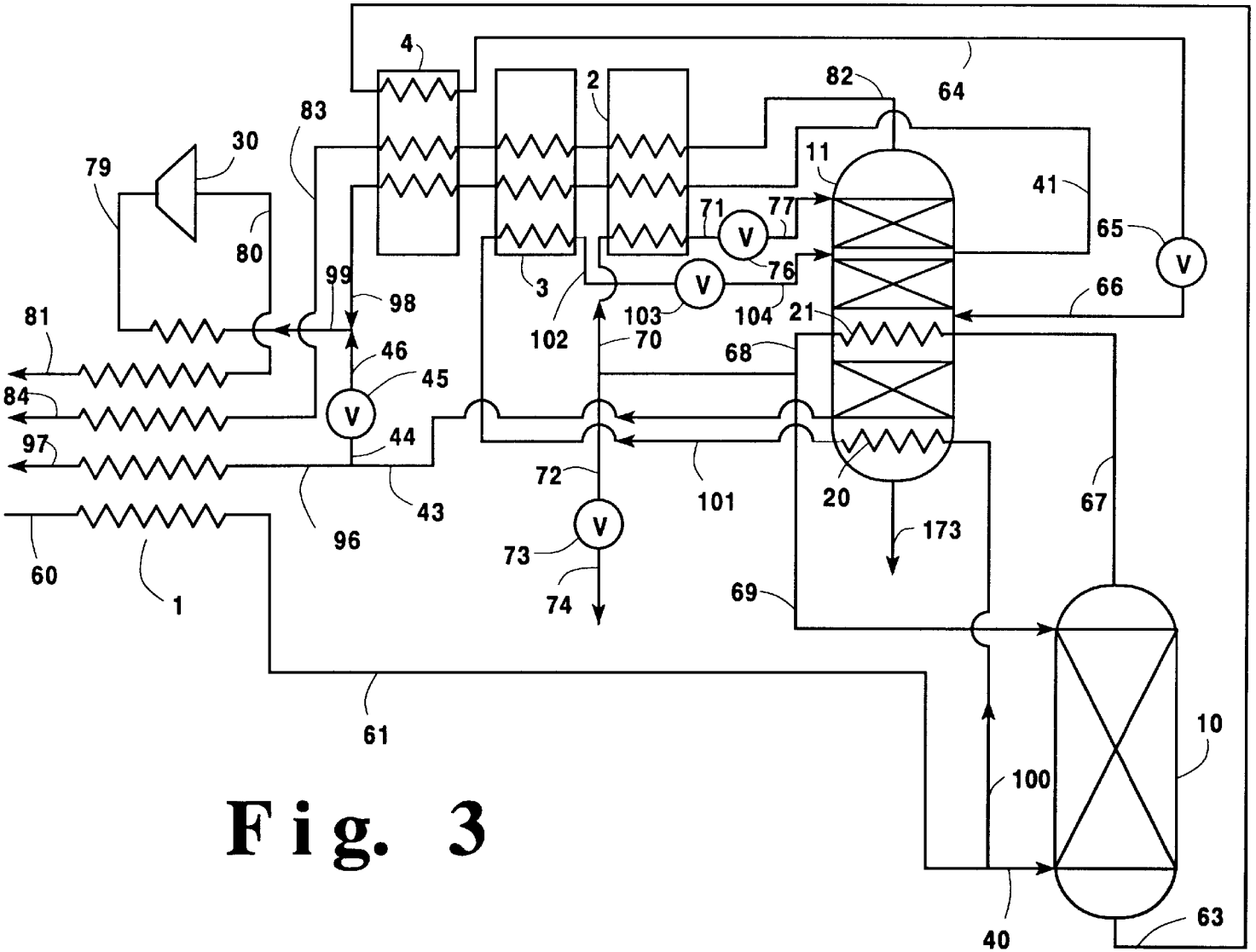
FIG. 3 is a schematic representation of another preferred embodiment of the invention wherein low purity oxygen is also produced.

FIG. 3 illustrates another embodiment of the invention wherein low purity oxygen is also produced at an elevated pressure. Those aspects of the embodiment illustrated in FIG. 3 which are common with the embodiment illustrated in FIG. 1 will not be discussed again in detail.

Referring now to FIG. 3, only a portion 100 of feed air stream 61 is passed through bottom reboiler 20. The remaining portion 40 is passed directly into first column 10. Resulting feed air stream 101 from bottom reboiler 20 is subcooled by passage through heat exchanger 3. Resulting stream 102 is passed through valve 103 and as stream 104 into second column 11. Oxygen-enriched bottom liquid from first column 10 is subcooled by passage through heat exchanger 4 and then passed into second column 11 at the same level as that of intermediate heat exchanger 21. Nitrogen-enriched liquid stream 70 is subcooled by passage through heat exchanger 2 prior to being passed into second column 11. A portion of the oxygen-rich bottom liquid may be withdrawn from second column 11 as stream 73 and recovered as product low purity oxygen liquid. Nitrogen-rich vapor stream 82 is warmed by passage through heat exchangers 2, 3 and 4 prior to being passed into primary heat exchanger 1 for warming prior to recovery.

A first vapor stream 41, having an oxygen concentration generally within the range of from 1 to 15 mole percent, is withdrawn from the upper portion of second column 11 and warmed by passage through heat exchangers 2, 3 and 4 to form stream 98. A second oxygen-rich vapor stream 43, having an oxygen concentration which exceeds that of first vapor stream 41 and generally within the range of from 60 to 96 mole percent, is withdrawn from the lower portion of second column 11. A portion 44 of stream 43 is passed through valve 45 and as stream 46 is combined with stream 98 to form stream 99 which partially traverses primary heat exchanger 1 emerging as stream 79 which is further processed as previously described. Another portion 96 of stream 43 is warmed by passage through primary heat exchanger 1 and recovered as product low purity oxygen 97 at a pressure generally within the range of from 23 to 68 psia.

The invention enables the production of elevated pressure high purity nitrogen without need for product compression at much lower unit separation power requirements than that possible with conventional single column systems for producing high purity elevated pressure nitrogen without need for product compression. For example, employing the embodiment illustrated in FIG. 1, one can produce nitrogen containing less than 2 ppm oxygen at 35 psia at a unit separation power usage of 2.8 kWh/1000 CF (kilowatt-hour per thousand cubic feet of nitrogen). Using the embodiment illustrated in FIG. 3, wherein by-product oxygen having a purity of 90 mole percent is also recovered, the unit separation power usage is still only 3.3 kWh/1000 CF. In comparison, the unit separation power for a typical single column cryogenic air separation plant heretofore employed to produce elevated pressure nitrogen without product compression is about 5.4 kWh/1000 CF.

Now by the use of this invention one can effectively produce high purity nitrogen at elevated pressure without need for product compression and, optionally also produce low purity oxygen, more efficiently than with the use of conventional systems. Although the invention has been described in detail with reference to certain preferred embodiments, those skilled in the art will recognize that there are other embodiments of the invention within the spirit and the scope of the claims.

I claim:

1. A method for producing nitrogen comprising:

(A) passing feed air into a first column and separating feed air within the first column by cryogenic rectification into oxygen-enriched bottom liquid and nitrogen-enriched top vapor;

(B) passing oxygen-enriched bottom liquid from the first column into a second column and producing oxygen-rich bottom liquid and nitrogen-rich top vapor by cryogenic rectification within the second column;

(C) vaporizing at least some of the oxygen-rich bottom liquid to produce oxygen-rich vapor;

(D) condensing nitrogen-enriched top vapor by indirect heat exchange with fluid from above the bottom of the second column;

(E) turboexpanding a portion of the oxygen-rich vapor; and (F) recovering nitrogen-rich top vapor as product nitrogen.

2. The method of claim 1 wherein the oxygen-rich bottom liquid is vaporized by indirect heat exchange with feed air which is then passed into the first column.

3. The method of claim 1 wherein the oxygen-rich bottom liquid is vaporized by indirect heat exchange with feed air which is then passed into the second column.

4. The method of claim 1 further comprising compressing a portion of the nitrogen-rich vapor, condensing the compressed portion and passing the condensed compressed portion into the first column.

5. The method of claim 1 further comprising recovering some of at least one of the oxygen-rich bottom liquid and the oxygen-rich vapor as product low purity oxygen.

6. Apparatus for producing nitrogen comprising:

(A) a first column and means for passing feed air into the first column;

(B) a second column having a bottom reboiler and an intermediate heat exchanger;

(C) means for passing fluid from the lower portion of the first column into the second column;

(D) means for passing fluid from the upper portion of the first column through the intermediate heat exchanger;

(E) a turboexpander and means for passing fluid from the lower portion of the second column through the turboexpander; and (F) means for recovering fluid from the upper portion of the second column as product nitrogen.

7. The apparatus of claim 6 further comprising means for passing feed air to the bottom reboiler and means for passing feed air from the bottom reboiler into at least one of the first column and the second column.

8. The apparatus of claim 6 further comprising a nitrogen product compressor, means for passing fluid from the upper portion of the second column to the nitrogen product compressor, and means for passing fluid from the nitrogen product compressor to the first column.

9. The apparatus of claim 6 further comprising means for recovering fluid from the lower portion of the second column.

10. The apparatus of claim 6 further comprising means for passing fluid from the upper portion of the second column to the turboexpander.

* * * * *